US005496120A

United States Patent [19]

Kakuguchi

[11] Patent Number: 5,496,120

[45] Date of Patent: Mar. 5, 1996

[54] DRIVE FORCE TRANSMISSION MECHANISM

[75] Inventor: Kazuhiro Kakuguchi, Kawasaki, Japan

[73] Assignee: Fujitsu Limited, Kanagawa, Japan

[21] Appl. No.: 340,466

[22] Filed: Nov. 14, 1994

Related U.S. Application Data

[63] Continuation of Ser. No. 61,530, May 14, 1993, abandoned, which is a continuation of Ser. No. 615,545, Nov. 19, 1990, abandoned.

[30] Foreign Application Priority Data

Nov. 20, 1989 [JP] Japan ..... 1-301018

[51] Int. Cl.[6] ..... B41J 19/12

[52] U.S. Cl. ..... 400/569; 400/691; 400/692

[58] Field of Search ..... 400/569, 691, 400/692; 411/549; 74/606 R

[56] References Cited

U.S. PATENT DOCUMENTS

| | | | |
|---|---|---|---|
| 3,766,801 | 10/1973 | Wiegand | 74/606 R |
| 4,347,759 | 9/1982 | Renk et al. | 74/606 R |
| 4,616,944 | 10/1986 | Galatha et al. | 400/692 |
| 4,732,502 | 3/1988 | Yokoi | 400/693 |
| 4,832,306 | 5/1989 | Bossack | 248/674 |

FOREIGN PATENT DOCUMENTS

| | | | |
|---|---|---|---|
| 166131 | 1/1986 | European Pat. Off. . | |
| 458248 | 5/1991 | European Pat. Off. | 400/692 |
| 2617436 | 1/1989 | France . | |
| 0000986 | 1/1985 | Japan | 400/569 |
| 0089382 | 5/1985 | Japan | 400/692 |
| 60-14374 | 6/1985 | Japan . | |
| 0135269 | 6/1988 | Japan | 400/569 |
| 0258842 | 8/1988 | Netherlands | 411/549 |

OTHER PUBLICATIONS

IBM Technical disclosure bulletin vol. 32, No. 8A. Jan. 1990; "Computer printer drive shaft and bearings".

Patent Abstracts of Japan, vol. 11, No. 281 (M-624) (2728), Sep. 11, 1987, Japanese Patent Publication 62-82062, Dated: Apr. 15, 1987, By: Mizoguchi, For: Sheet Material Feed Apparatus.

IBM, Molded gear retention device, vol. 27, No. 100, Mar. 1985.

*Primary Examiner*—Ren Yan
*Assistant Examiner*—John S. Hilten
*Attorney, Agent, or Firm*—Nikaido, Marmelstein, Murray & Oram

[57] ABSTRACT

A drive force transmission mechanism is applied to, for example, a printer, to transmit a drive force to a driven element such as a platen, a paper feeder, and an ink ribbon cassette, etc., included in the printer. The drive force transmission mechanism including a subsidiary frame detachably attached to a main frame such as a printer frame and having at least one shaft member projected therefrom, and at least one transmission member such as a gear rotatably supported by the shaft member to be engaged with the driven element so that the drive force is transmitted thereto. Since the transmission member is rotatably supported by the shaft member of the subsidiary frame detachably attached to the main frame, only the subsidiary frame need be replaced if a shaft member is broken.

6 Claims, 6 Drawing Sheets

DRIVE FORCE TRANSMISSION MECHANISM

This application is a continuation of application Ser. No. 08/061,530 filed May 14, 1993, which is a continuation of application Ser. No. 07/615,545, filed Nov. 19, 1990 both abandoned.

BACKGROUND OF THE INVENTION

1) Field of the Invention

The present invention relates to a drive force transmission mechanism for transmitting a drive force to a driven element. In particular, the drive force transmission mechanism according to the present invention can be advantageously applied to a printer to transmit a drive force to a driven element such as a platen, a paper feeder, and an ink ribbon cassette, etc., included in the printer.

2) Description of the Related Art

A serial printer, for example, a wire dot printer, comprises a printer frame, a platen rotatably supported by side walls of the printer frame, a carriage slidably mounted on a guide bar supported by the side walls of the printer frame, so that the carriage is reciprocatedly movable along a longitudinal axis of the platen, a wire dot printing head mounted on the carriage and having a printing face facing and close to a surface of the platen, and a paper feeder such as a pin-belt tractor provided between the side walls of the printer frame for feeding a continuous form paper to a printing position defined between the platen and the printing head. In this printer, the platen and the paper feeder are driven by a common electric motor mounted on one of the side walls of the printer frame, and a rotational drive force is transmitted from the motor to the platen and the paper feeder through the intermediary of a drive force transmission mechanism formed as a reduction gear train. This reduction gear train is provided on the side wall of the printer frame on which the motor is mounted, and is disposed between an output gear of the motor and two gears which are fixed on drive shaft ends of the platen and the paper feeder extended through the side wall of the printer frame.

Conventionally, each of the gears forming the reduction gear train is rotatably mounted on a shaft member projected from an outer wall surface of the side wall of the printer frame. When the printer frame is formed of a metal material, for example, steel, the shaft members are also formed of steel and are securely riveted to the side wall of the metal frame. On the other hand, when the printer frame is moulded from a suitable synthetic resin material, the shaft members are integrally moulded with the printer frame. In both cases, the shaft members are formed as a part of the printer frame and are permanently secured thereto, and accordingly, if one of the shaft members is broken, the printer frame per se must be replaced by a new unit. As is well known, the replacing of the printer frame is time-consuming and expensive, because the parts of the printer must be first disassembled and then reassembled.

In the prior art printer as described above, the carriage on which the printing head is mounted is provided with an ink ribbon cassette holder and an ink ribbon winder associated therewith. In general, an ink ribbon cassette has two reels, i.e., a driven reel and a drive reel, and the driven reel is wound with an ink ribbon having a free end thereof connected to the drive reel. The ink ribbon cassette is held by the ink ribbon cassette holder in such a manner that an ink ribbon of the cassette runs between the platen and the printing face of the printing head, and the driven reel of the ink ribbon cassette is engaged with the ink ribbon winder. During a printing operation, the ink ribbon winder is driven by a drive mechanism for the carriage, whereby the ink ribbon can be drawn from the driven reel and wound up by the drive reel. The ink ribbon winder includes a drive force transmission mechanism for transmitting a drive force from the carriage drive mechanism to the drive reel of the ink ribbon cassette, and the drive force transmission mechanism is formed as a gear train provided on the carriage. Each of the gears forming the gear train is rotatably supported on a shaft member projected from a body or main frame of the carriage, and these shaft members are also permanently secured to the main frame of the carriage. Accordingly, if one of the shaft members is broken, the carriage body or main frame per se must be replaced by a new unit. This replacing of the carriage body is also time-consuming and expensive, because the parts mounted on the carriage body must be first disassembled and reassembled.

SUMMARY OF THE INVENTION

Therefore, an object of the present invention is to provide a drive force transmission mechanism for transmitting a drive force to a driven element supported by a main frame, wherein the drive force transmission mechanism is accommodated in and held by a subsidiary frame which is detachably attached to the main frame, whereby the subsidiary frame can be easily and inexpensively replaced when the subsidiary frame is broken.

In accordance with the present invention, there is provided a drive force transmission mechanism for transmitting a drive force to a driven element supported by a main frame, which mechanism comprises: a subsidiary frame detachably attached to the main frame and having at least one shaft member projected therefrom; and at least one transmission member rotatably supported by the shaft member, to be engaged with the driven element so that the drive force is transmitted thereto. Therefore, according to the present invention, only the subsidiary frame need be replaced when the shaft member is broken because the subsidiary frame is detachably attached to the main frame.

The transmission member comprises a gear, a cam, or a lever, and a free end of the shaft member is preferably received in a hole formed in the main frame, whereby a rigidity of the shaft member can be increased. The subsidiary frame and the shaft member may be integrally moulded from a suitable synthetic resin, such as acrylonitrile-butadiene-styrene, polycarbonate, polyacetal, and tetrafluoroethyrene.

BRIEF DESCRIPTION OF THE DRAWINGS

The objects and advantages of the present invention will be better understood from the following description, with reference to the accompanying drawings, in which.

DESCRIPTION OF THE PREFERRED EMBODIMENTS

Figure 1:
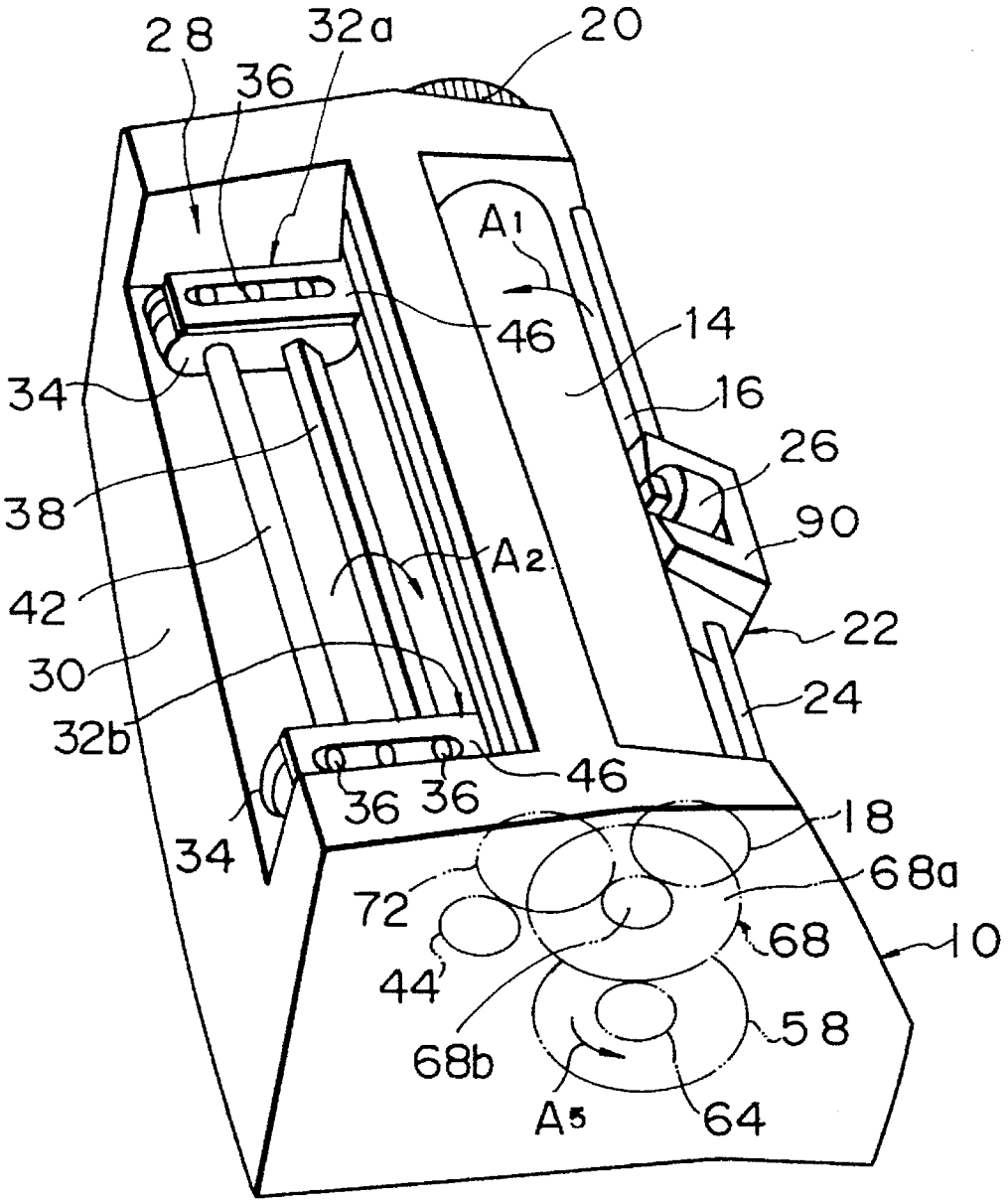
FIG. 1 is a schematic perspective view showing a wire dot printer in which the present invention is embodied.

FIG. 1 is a perspective view of a wire dot printer in which the present invention is embodied. This printer comprises a housing 10 in which a printer frame or main frame is housed. The printer frame is not shown in FIG. 1, but a portion thereof is indicated by reference numeral 12 in FIG. 2. In this embodiment, although the printer frame is preferably moulded from a suitable synthetic resin such as acrylonitrile-butadiene-styrene (ABS), polycarbonate, polyacetal, tetrafluoroethyrene (Teflon), or the like, it may be formed of a suitable metal material such as steel, aluminum, or the like.

A platen 14 is provided between side walls of the printer frame and has shaft portions (not shown) projected from the end faces thereof and rotatably supported by bearings (not shown) mounted in the side walls of the printer frame, respectively. An end of one shaft portion of the platen 14 is extended outward from the corresponding bearing and a gear 18 is fixed on the extended end thereof. Note, in FIG. 1, a profile of the gear 18 is shown only by a chain line. During a printing operation, the platen 14 is rotationally driven in a direction indicated by an arrow $A_1$ in FIG. 1, as mentioned hereinafter. The other shaft portion of the platen 14 is extended through a side wall of the housing 10 and has a manual knob 20 fixed thereon. A carriage 22 is slidably mounted on a guide bar 24 supported by the side walls of the printer frame, so that the carriage 22 is reciprocatedly movable along a longitudinal axis of the platen 14, and a wire dot printing head 26 is mounted on the carriage 22 so that a printing face thereof faces and is close to a surface of the platen 14.

Figure 2:
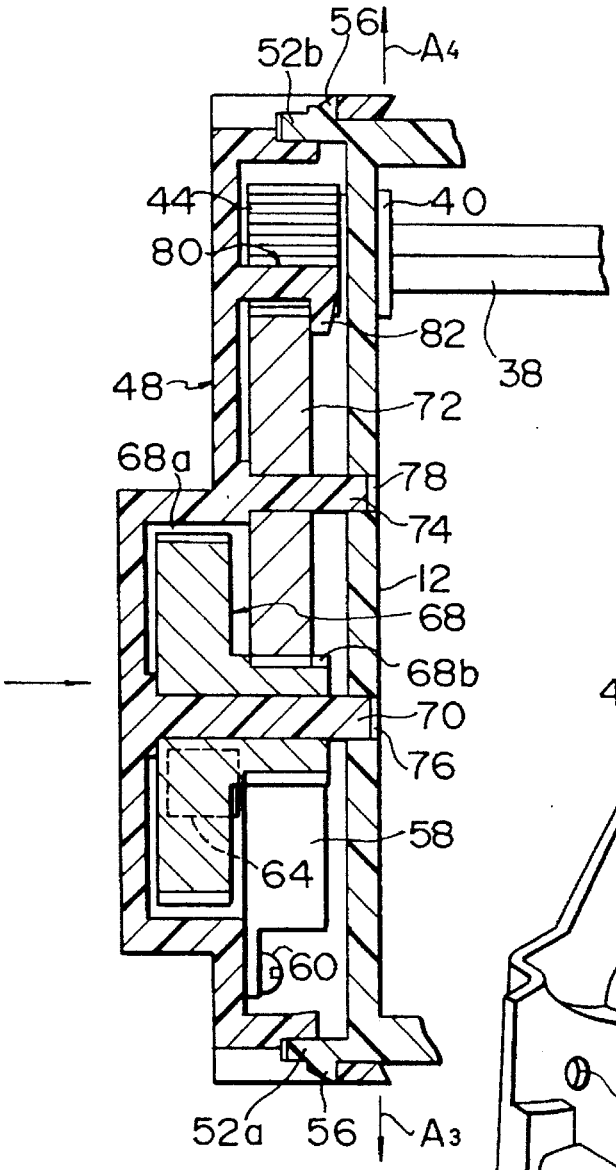
FIG. 2 is a sectional view of a first embodiment of a drive force transmission mechanism according to the present invention, applied to the printer of FIG. 1 to transmit a drive force to a platen and a paper feeder included therein.

A well-known paper feeder, i.e., a pin-belt tractor 28 is provided between the side walls of the printer frame, for feeding a continuous form paper toward a printing position defined between the platen 14 and the printing face of the printing head 26. As shown in FIG. 1, the pin-belt tractor 28 is exposed to an outside at an opening 30 formed in the housing 10, and includes a pair of pin-belt assemblies **32*a* and 32*b* which are engaged with two rows of perforations formed along the side margins of the continuous form paper, respectively. In particular, the pin-belt assembly 32*a*, 32*b* includes a frame member 34, drive and driven pulleys (not shown) provided in and rotatably supported by the frame member 34, and an endless belt entrained therebetween and having pins 36. The drive pulley is slidably mounted on a square cross-sectional shaft 38 which is rotatably supported by the side walls of the printer frame through the intermediary of bearings 40 (only one thereof shown in FIG. 2), and the driven pulley is slidably mounted on a round cross-sectional shaft 42 which is securely supported by the side walls of the printer frame. Due to the square cross section of the shaft 38, the drive pulley cannot be rotated until the shaft 38 is rotated, whereas the driven pulley is rotatable with respect to the round cross-sectional shaft 42. As shown in FIG. 2, an end of the square cross-sectional rod 38 is extended outward from the bearing 40 and has a gear 44 fixed on the extended end thereof. Note, in FIG. 1, a profile of the gear 44 is shown by a chain line. The continuous form paper is set in the pin-belt tractor 28 in such a manner that the two rows of the pins 36 of the pin-belt assemblies 32*a* and 32*b* are received in the two rows of the perforations of the side margins of the continuous form paper. Note, when the continuous form paper is set, a lid member 46 hinged to the frame member 34 is opened, and after the setting of the continuous form paper is completed, the lid member 46 is closed as shown in FIG. 1. During a printing operation, the square cross-sectional shaft 38** is rotationally driven in a direction indicated by an arrow $A_2$ in FIG. 1, as mentioned hereinafter.

Figure 3:
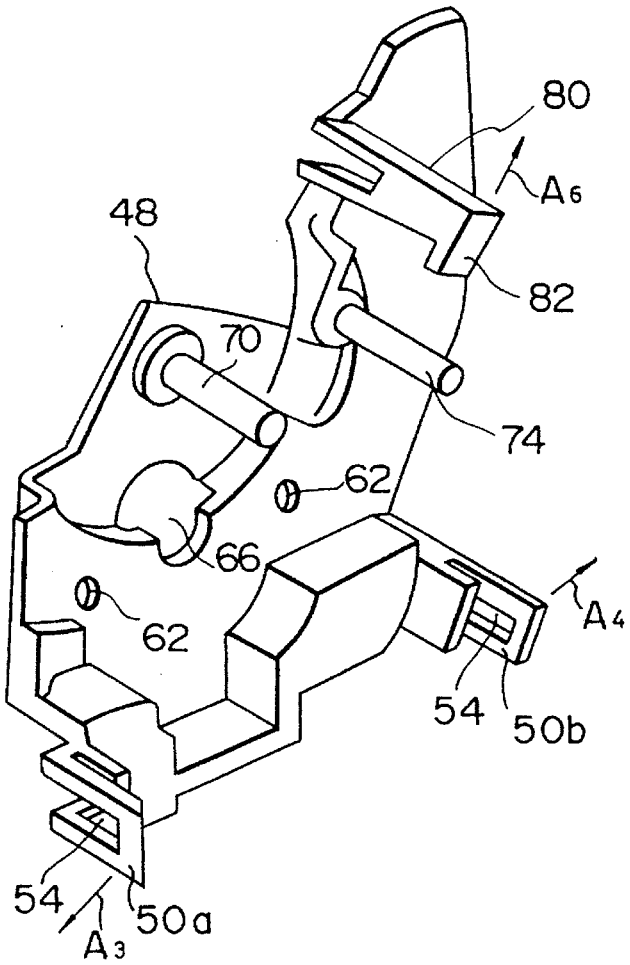
FIG. 3 is a perspective view of a subsidiary frame forming a part of the drive force transmission mechanism shown in FIG. 2.

According to the present invention, the printer frame 12 is provided with a subsidiary frame 48 detachably attached to the side wall thereof, as shown in FIG. 2. To detachably attach the subsidiary frame to the printer frame 12, the subsidiary frame 48 has a pair of tongue elements **50*a* and 50*b* integrally formed therewith, as best shown in FIG. 3, and the printer frame 12 has a pair of fixture elements 52*a* and 52*b* integrally extended from the side wall thereof and detachably connected to the tongue elements 50*a* and 50*b*, respectively, as shown in FIG. 2. In particular, each of the tongue elements 50*a* and 50*b* has an elongated slot 54 formed therein, and each of the fixture elements 52*a* and 52*b* has a protrusion 56 projected therefrom and snugly engaged with the corresponding slot 54. The snug engagement of the protrusion 46 with the slot can be achieved by resiliently bending the tongue elements 50*a* and 50*b*** outward in the directions indicated by arrows $A_3$ and $A_4$ in FIGS. 2 and 3, respectively.

The subsidiary frame 48 is used to accommodate and hold a drive force transmission mechanism for transmitting a rotational drive force from an electric motor 58 to the platen 14 and the pin-belt tractor 28. In this embodiment, the electric motor 58 is also accommodated in the subsidiary frame 48 and is attached to an inner wall thereof by a pair of screws 60 (only one thereof shown in FIG. 2). Note, in FIG. 3, a pair of threaded holes for the screws 60 is indicated by reference numerals 62. The motor 58 has a gear 64 fixed on an output shaft thereof, which gear 64 is disposed in an opening 66 formed in the subsidiary frame 48 when the motor 58 is attached thereto. The drive force transmission mechanism is formed as a reduction gear train including a double gear 68 having large and small gear portions **68*a* and 68*b* and rotatably mounted on a shaft member 70 which is integrally projected from the inner wall of the subsidiary frame 48. The large gear portion 68*a* of the double gear 68 is engaged with the gear 64 fixed on the output shaft of the motor 58. The reduction gear train also includes a gear 72 engaged with the small gear portion 68*b* of the double gear 68 and rotatably mounted on a shaft member 74 which is integrally projected from the inner wall of the subsidiary frame 48. Note, in FIG. 1, profiles of the motor 58, the gear 64, the double gear 68, and the gear 72 are shown by chain lines. The gear 44 of the square cross-sectional shaft 38 is engaged with the gear 72, as shown in FIGS. 1 and 2, and the gear 18 of the platen 14 is engaged with the small gear portion 68***b* of the double gear 68, as shown in FIG. 1, whereby the platen 14 and the square cross-sectional shaft 38 can be rotated in the directions indicated by the arrows $A_1$ and $A_2$, respectively, when the gear 64 is rotationally driven by the motor 58 in a direction indicated by an arrow $A_5$ in FIG. 1.

Although the subsidiary frame 48 is most preferably moulded from tetrafluoroethyrene having a low coefficient of friction (i.e., superior lubricating property) and exhibiting a high resistance to wear, another suitable synthetic resin such as acrylonitrile-butadiene-styrene, polycarbonate, polyacetal, or the like, may be used, if necessary. Also, the subsidiary frame 48 may be made of a suitable metal material such as steel, aluminum, or the like.

In the embodiment as mentioned above, although the motor 58 is supported by the subsidiary frame 48, it may be attached to the side wall of the printer frame 12, if necessary.

Preferably, free ends of the shaft members 70 and 74 are received in holes 76 and 78 formed in the side wall of the printer frame 12, respectively, as shown in FIG. 2, whereby a rigidity of the shaft members 70 and 74 can be increased.

Also, preferably, the gear 72 is held in place on the shaft member 74 by a support member 80 integrally projected from the inner wall of the subsidiary frame 48. Namely, the support member 80 has a pawl 82 engaged with a side face of the gear 72, as shown in FIG. 2, whereby the gear 72 can be held at a given position on the shaft member 74. The gear 72 can be mounted on the shaft member 74 by resiliently bending the support member 80 in a direction indicated by an arrow $A_6$ in FIG. 3. Alternatively, a well-known retaining ring may be fitted in a groove (not shown) formed around the shaft member 74, to hold the gear 72 at the given position on the shaft member 74.

As apparent from the foregoing, since the gears 68 and 72 are rotatably supported by the shaft members 70 and 74 of the subsidiary frame 48 detachably attached to the side wall of the printer frame 12, only the subsidiary frame 48 need be replaced if any one of the shaft members 70 and 74 is broken.

Figure 4:
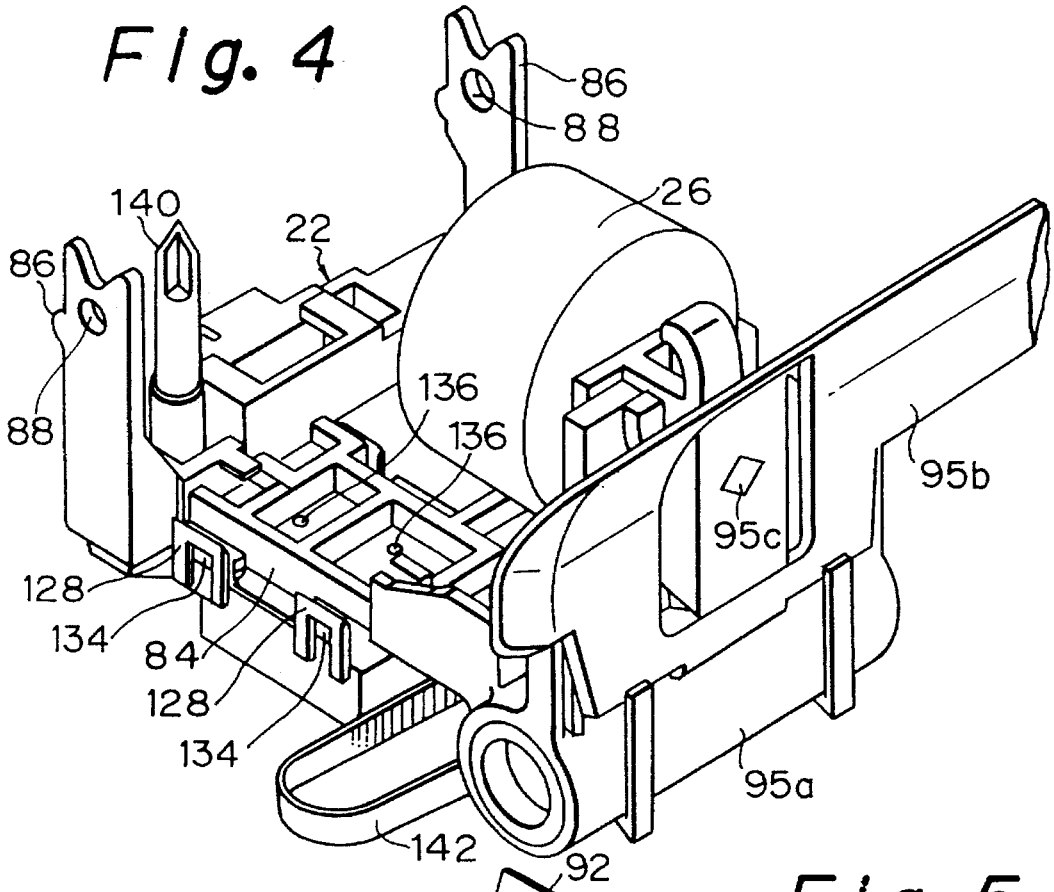
FIG. 4 is a perspective view showing a printing head carriage included in the printer of FIG. 1, to which a second embodiment of a drive force transmission mechanism according to the present invention is applied to transmit a drive force to a drive reel of an ink ribbon cassette.
Figure 5:
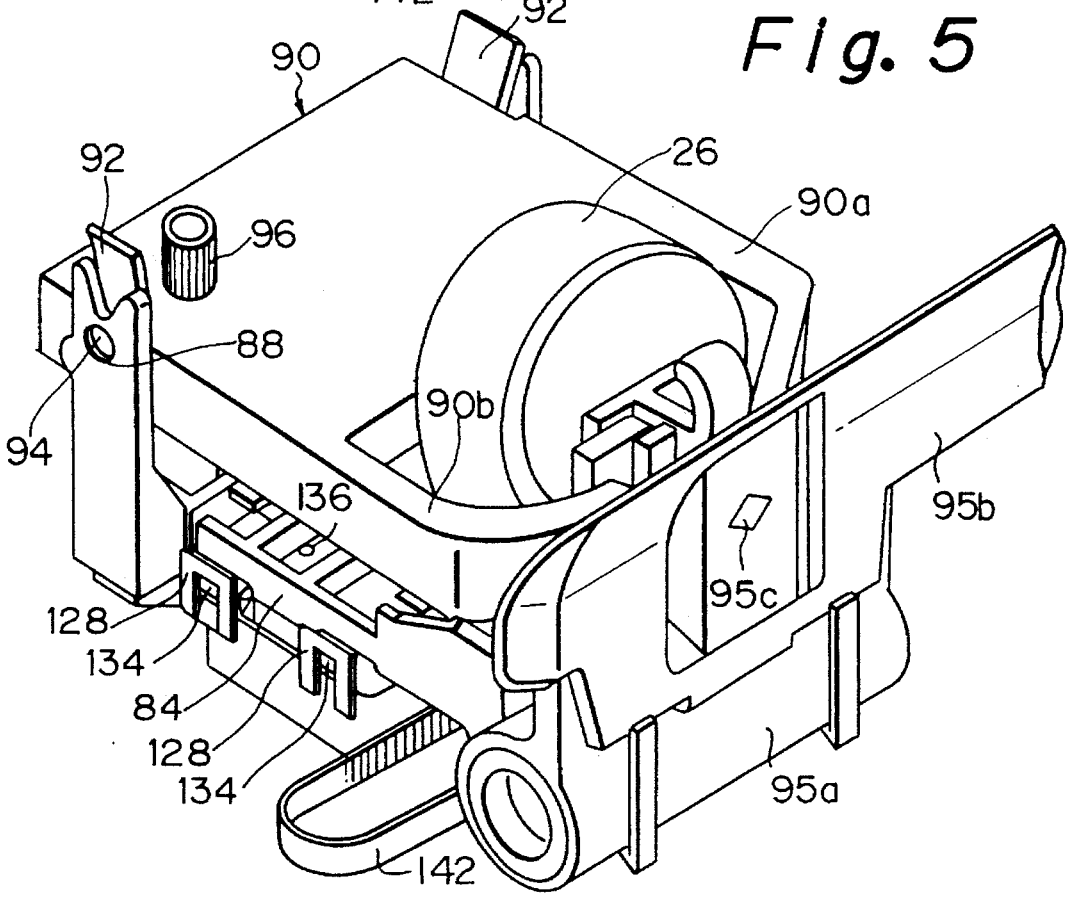
FIG. 5 is a perspective view similar to FIG. 4, showing the ink ribbon cassette held by an ink ribbon cassette holder provided on the carriage.

FIG. 4 is an enlarged perspective view showing the carriage 22 in more detail, in which the present invention is also embodied. The carriage 22 comprises a carriage body or main frame 84 on which the printing head 26 is mounted. The main frame 84 is provided with an ink ribbon cassette holder including a pair of holder plate members 86 upwardly extended from the main frame 84 and each having a hole 88 formed therein. As shown in FIG. 5, an ink ribbon cassette 90 is held by the holder plate members 86. In particular, the ink ribbon cassette 90 is provided with a pair of leaf spring elements 92 extended from opposite side walls thereof and each having a protrusion 94 (only one thereof shown in FIG. 5) projected from the outside surface of the corresponding leaf spring element 92. When the ink ribbon cassette 90 i set in the ink ribbon cassette holder, the leaf spring elements 92 are resiliently bent inward so that each of the protrusions 94 is snugly received in the corresponding hole 88, and thus the ink ribbon cassette 90 is held by the holder plate members 86, as shown in FIG. 5. The carriage 22 is also provided with a guide sleeve 95*a* integrated with the main frame 84 and slidably mounted on the guide bar 24, and a paper guide plate 95*b* attached to the guide sleeve 95*a* to upwardly extend therefrom for guiding the continuous form paper during a printing operation. The guide plate 95*b* has a through opening 95*c* aligned with and registered with the printing face of the printing head 26. Note, preferably, the main frame 84, the holder plate members 86, and the guide sleeve 95*a* are integrally moulded from a suitable synthetic resin such as acrylonitrile-butadiene-styrene, polycarbonate, polyacetal, tetrafluoroethyrene, or the like, but these units may be formed of a suitable metal material such as steel, aluminum, or the like.

The ink ribbon cassette 90 includes two reels, i.e., a driven reel and a drive reel (not shown) rotatably provided therein, and an ink ribbon having one end connected to the driven reel, and the other end thereof connected to and wound by the drive reel. The ink ribbon is wound from the driven reel to the drive reel while passing through two ink ribbon guides 90*a* and 90*b* of the ink ribbon cassette 90. The ink ribbon cassette 90 is set in the ink ribbon cassette holder in such a manner that an ink ribbon section, which is exposed outside between the ink ribbon guides 90*a* and 90*b*, faces a printing face of the printing head 26. The drive reel of the ink ribbon cassette 90 has a knurled head 96 projected outside from the ink ribbon cassette 90, as shown in FIG. 5, and is used to tighten the ink ribbon extended between the driven and drive reels, before the ink ribbon cassette 90 is set in the ink ribbon cassette holder. During a printing operation, the drive reel of the ink ribbon cassette 90 is driven by an ink ribbon winder incorporated in the carriage 22, whereby the ink ribbon is drawn from the driven reel and wound up by the drive reel.

Figure 6:
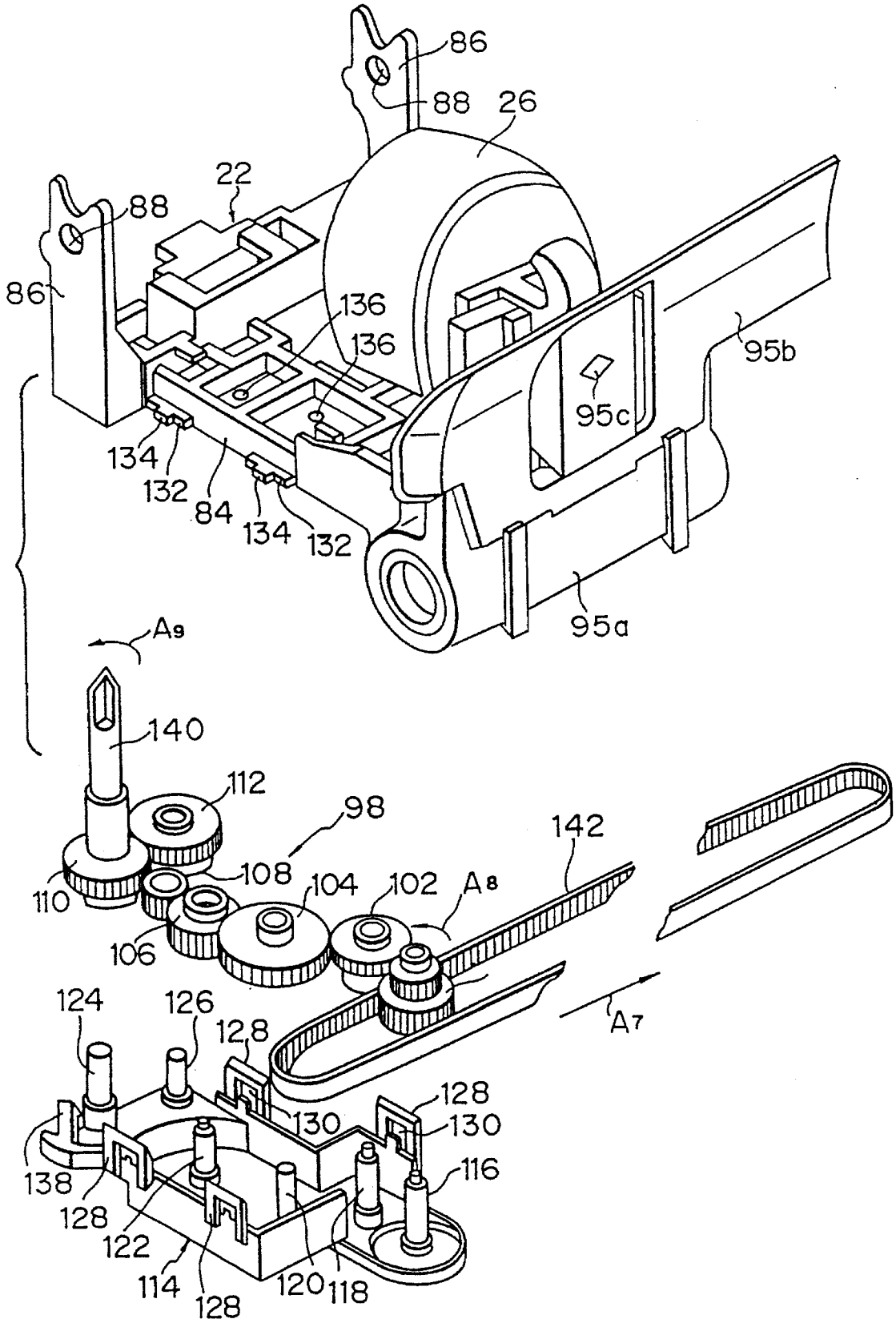
FIG. 6 is an exploded view of the printing head carriage shown in FIG. 4.

Referring to FIG. 6, the ink ribbon winder comprises a gear train 98 including seven gears 100, 102, 104, 106, 108, 110, and 112. The gear train 98 is accommodated in and held by a subsidiary frame 114 which is detachably attached to the main frame 84, and which has six shaft members 116, 118, 120, 122, 124, and 126 integrally projected from the inner wall thereof. The gears 100, 102, 104, 106, 110, and 112 are rotatably mounted on the shaft members 116, 118, 120, 122, 124, and 126, respectively, and the gear or planetary gear 108 is rotatably supported by an arm (not shown) extended from the gear 106 so that the gear 108 is selectively engaged with one of the gears 110 and 112. The subsidiary frame 114 has four tongue elements 128 integrally projected therefrom and each having a slot 130 formed therein, and the main frame 84 has four fixture elements 132 (only two thereof are shown in FIG. 6) integrally projected therefrom and having protrusions 134. The subsidiary frame 114 is detachably attached to the main frame 84 by snugly engaging the protrusions 134 of the fixture elements 132 with the slots 130 of the tongue elements 128, respectively, as shown in FIGS. 4 and 5. Preferably, the free ends of the shaft members 116, 118, 120, 122, and 126 are received in holes 136 (only two thereof shown in FIG. 6) formed in the main frame 84, respectively, whereby a rigidity of the shaft members 116,118,120,122, and 126 can be increased. The gear 110 is supported by a support member 138 in substantially the same manner as the gear 72 by the support member 80 (FIG. 2).

When the subsidiary frame 114 with the gear train 98 is attached to the main frame 22, a shaft 140 upwardly extended from the gear 110 is stood upright beside one of the holder plate members 86, as shown in FIG. 4. Then, when the ink ribbon cassette 90 is set in the ink ribbon cassette holder, as shown in FIG. 5, the shaft 140 is engaged with the drive reel of the ink ribbon cassette 90. The ink ribbon winder is driven by a toothed endless belt 142 which is used to move the carriage 22 along the platen 14. In particular, the toothed endless belt 142 is entrained between drive and driven toothed pulleys (not shown) so that the toothed endless belt 142 has two running portions therebetween, one of which is engaged with a toothed pulley portion of the gear 100, and the other running portion is connected to the carriage 22. Note, a gear portion of the gear 100 is engaged with the gear 102. For example, when the carriage 22 is moved in a direction indicated by an arrow $A_7$ in FIG. 6, the double gear 100 is rotated counterclockwise, as shown by an arrow $A_8$, so that the gear 110 (and therefore the drive reel of the ink ribbon cassette 90) is rotated counterclockwise, as shown by an arrow $A_9$, whereby the ink ribbon is wound up by the drive reel. In this case, the gear 108 is engaged with the gear 112. On the other hand, when the carriage 22 is moved in the reverse direction, the double gear 100 is rotated clockwise, but the counterclockwise rotation of the gear 110 is maintained because the gear 108 is disengaged from the gear 112 and engaged with the gear 110.

Although the subsidiary frame 114 is most preferably moulded from tetrafluoroethyrene, for the same reasons as mentioned above, another suitable synthetic resin such as acrylonitrile-butadiene-styrene, polycarbonate, polyacetal, or the like, can be used, if necessary. Also, the subsidiary frame 114 may be made of a suitable metal material such as steel, aluminum, or the like.

In this embodiment, since the gear train 98 is supported by the shaft members 116, 118, 120, 122, 124, and 126 of the subsidiary frame 114 detachably attached to the main frame 84, only the subsidiary frame 114 need be replaced if one of the shaft members 116, 118, 120, 122, 124, and 126 is broken.

Figure 7:
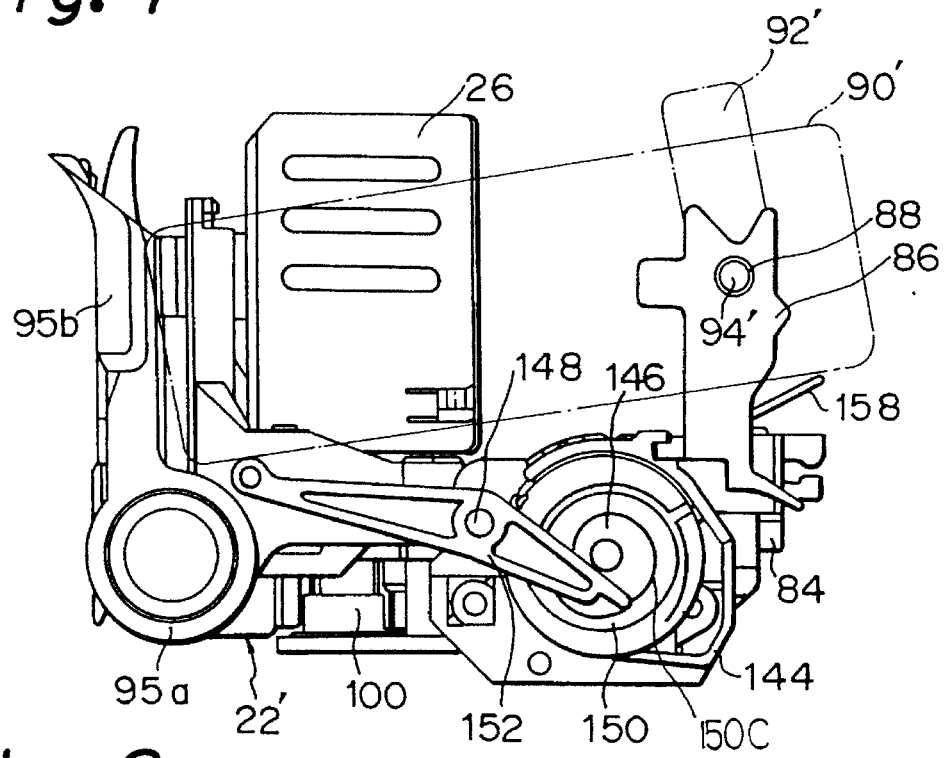
FIG. 7 is a side view showing a printing head carriage to which a third embodiment of a drive force transmission mechanism according to the present invention is applied to transmit a drive force to a color ink ribbon cassette held by the printing head carriage.
Figure 8:
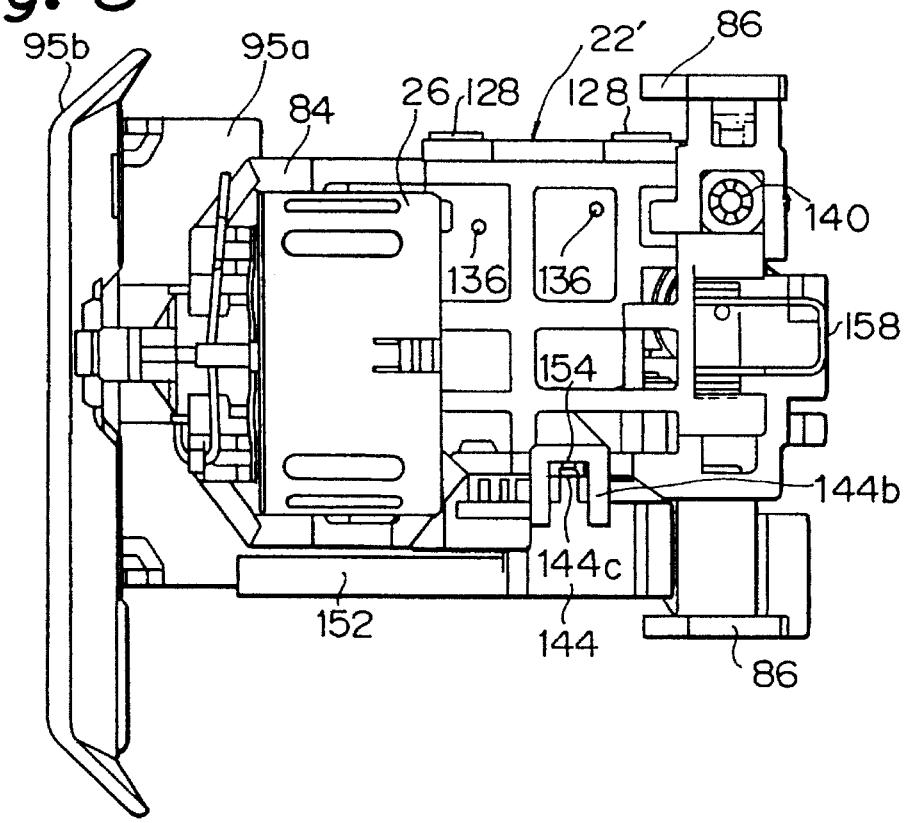
FIG. 8 is a plan view of the printing head carriage shown in FIG. 7.
Figure 9:
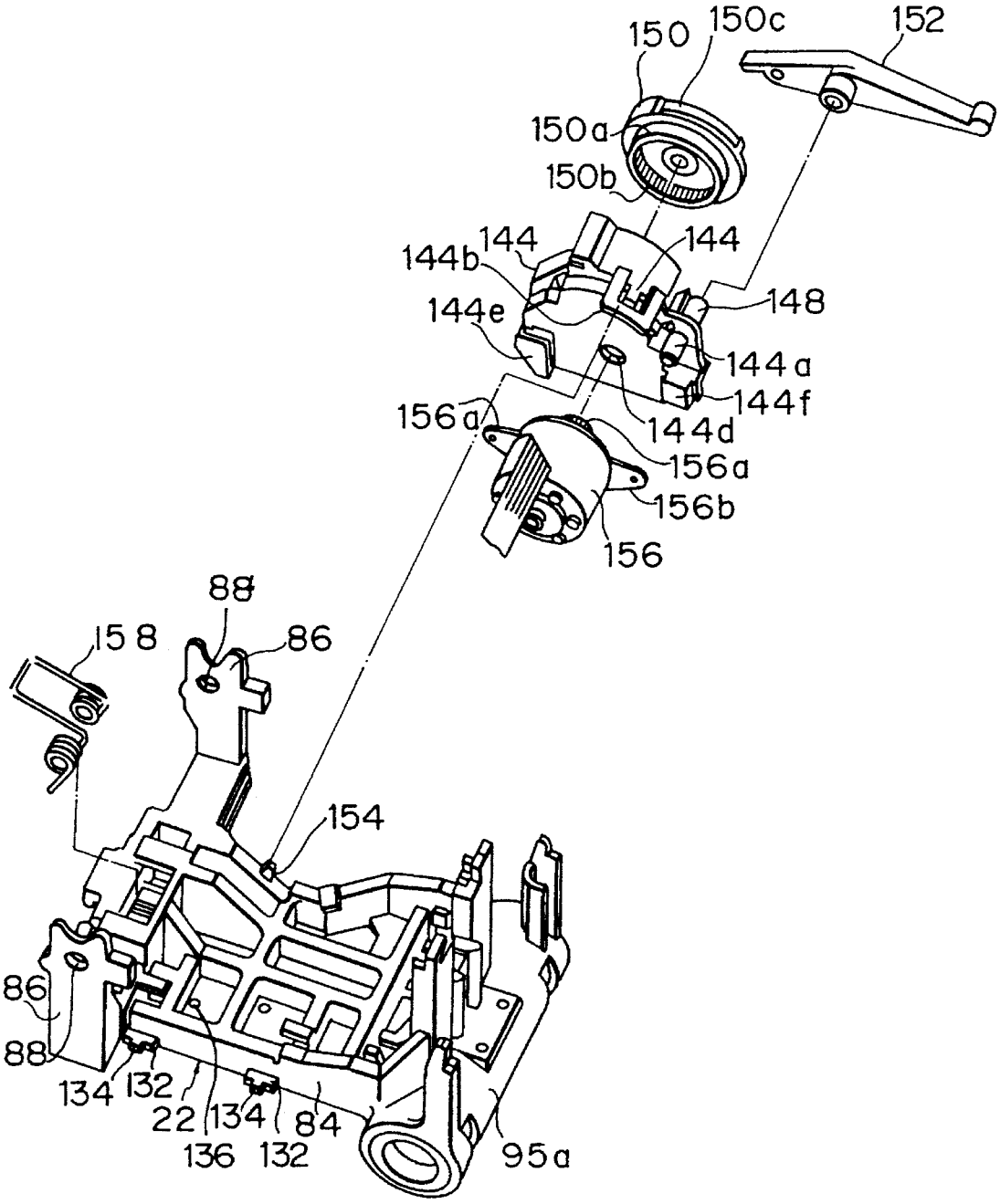
FIG. 9 is an exploded view of the carriage shown in FIGS. 7 and 8.

FIGS. 7 to 9 show a carriage 22' of another type, which includes elements similar to those of the carriage 22 shown in FIGS. 4 to 6, and which are indicated by the same reference numerals. The carriage 22' is characterized in that a color ink cassette 90' shown by a chain line is movably held by the holder plate members 86. In particular, similar to the ink ribbon cassette 90, the color ink ribbon cassette 90' is provided with a pair of leaf spring elements 92' extended from opposed side walls thereof and each having a protrusion 94' (only one thereof is shown in FIG. 7) projected from the outside surface of the corresponding leaf spring element 92', and is supported by the holder plate members 86 in the same manner as the ink ribbon cassette 90. Namely, the color ink ribbon cassette 90' is supported in such a manner that the protrusions 94' thereof are snugly received in the holes 88 of the holder plate members 86, respectively, but the color ink ribbon cassette 90' is rotatable about an axis of the protrusions 94'.

The color ink ribbon cassette 90' also includes two reels, i.e., a driven reel and a drive reel (not shown) rotatably provided therein, and one end of the color ink ribbon is connected to and wound up by the driven reel, and the other end thereof is connected to the drive reel. In this embodiment, the color ink ribbon has four different color (black, yellow, magenta, cyan) strip-like zones extending along a length of the color ink ribbon. Accordingly, the color ink ribbon cassette 90' is angularly moved about the axis of the protrusions 94' so that one of the different color strip-like zones is selectively made to face the printing face of the printing head 26 mounted on the main frame 84 of the carriage 22', whereby a color printing can be carried out. During a printing operation, the drive reel of the color ink ribbon cassette 90' is driven by the same ink ribbon winder as shown in FIG. 6. Namely, the shaft 140 driven by the gear train 98 is engaged with the drive reel of the color ink ribbon cassette 90', whereby the color ink ribbon can be drawn from the driven reel and wound up by the drive reel. Note, a loose engagement is made between the shaft 140 and the drive reel of the color ink ribbon cassette 90', so that an angular movement of the color ink ribbon cassette 90' about the axis of the protrusions 94' is possible.

A drive force transmission mechanism for transmitting a drive force to the color ink ribbon cassette 90', includes a subsidiary frame 144 detachably attached to the main frame 84 of the carriage 22' and having two shaft members 146 and 148 projected therefrom, a cam 150 rotatably supported by the shaft member 146, and a lever 152 rotatably supported by the shaft member 148. As shown in FIG. 9, in which the printing head 26 and the paper guide plate 95*b* are removed from the carriage 22', the subsidiary frame 144 has a protrusion 144*a* integrally projected therefrom and adapted to be inserted in a hole (not shown) formed in the main frame 84 of the carriage 22', and a tongue element 144*b* integrally projected therefrom and having a slot 144*c* formed therein. The subsidiary frame 144 is attached to the main frame 84 of the carriage 22' by inserting the protrusion 144*a* in the hole of the main frame 84 and by snugly engaging the tongue element 144*b* with a protrusion 152 formed on the main frame 84, whereby the subsidiary frame 144 is immovably attached to the main frame 84.

As apparent from FIG. 9, the cam 150 has a collar element 150*a* integrally projected therefrom, and an internal gear 150*b* is formed around the internal surface of the collar element 150*a*. Further, a drive motor 156 is attached to and supported by the subsidiary frame 144 so that an output gear 156*a* of the drive motor 156 passes through a hole 144*d* formed in the subsidiary frame 144 and is engaged with the internal gear 150*b* of the cam 150. For the attachment of the motor 156, the subsidiary frame 144 is provided with a pair of fixture elements 144*e* and 144*f* integrally formed therewith and having grooves formed in the fixture elements 144*e* and 144*f*, respectively, and fixture tongue elements 156*a* and 156*b* diametrically projected from the motor 156 are snugly engaged with the grooves of the fixture elements 144*e* and 144*f*, respectively. In particular, the groove of the fixture element 144*e* opens at inner and top sides thereof, whereas the groove of the fixture element 144*f* opens at inner and bottom sides thereof, and a snug engagement of the fixture tongue elements 156*a* and 156*b* with the grooves of the fixture elements 144*e* and 144*f* is obtained by turning the motor 154 counterclockwise in FIG. 9.

As shown in FIG. 7, one end of the lever 152 is engaged with a spiral cam face 150*c* formed on the cam 150, and the other end thereof is engaged with a bottom of the color ink ribbon cassette 90', whereby a rotation of the cam 150 results in an angular movement of the color ink ribbon cassette 90'. In particular, the color ribbon cassette 90' is angularly moved between a first extreme position as shown in FIG. 7 and a second extreme position at which the color ribbon cassette 90' is rotated clockwise from the first extreme position to a given angular position in FIG. 7, and is resiliently biased toward the first extreme position (FIG. 7) by a torsion spring 158 provided in the main frame 84 of the carriage 22' at a middle position between the holder plate members 86. With this arrangement, the angular movement of the color ink ribbon cassette 90' between the first and second extreme positions can be caused by the rotation of the cam 150. The rotation of the cam 150 is controlled so that the color ink ribbon cassette 90' is positioned at one of the first and second extreme positions and two middle positions therebetween, so that the corresponding one of the four different color strip-like zones of the color ink ribbon is made to face the printing face of the printing head 26.

Although the subsidiary frame 144 is most preferably moulded from tetrafluoroethyrene the same reason as mentioned above, another suitable synthetic resin such as acrylonitrile-butadiene-styrene, polycarbonate, polyacetal, or the like, may be used, if necessary. Also, the subsidiary frame 114 may be made of a suitable metal material such as steel, aluminum, or the like.

In this embodiment, since the cam 150 and the lever 152 is supported by the shaft members 146 and 148 of the subsidiary frame 144 detachably attached to the main frame 84 of the carriage 22', only the subsidiary frame 144 need be replaced if one of the shaft members 146 and 148 is broken.

Finally, it will be understood by those skilled in the art that the foregoing description is of preferred embodiments of the present invention, and that various changes and modifications can be made thereto without departing from the spirit and scope thereof.

I claim:

1. A drive force transmission mechanism of a printer for transmitting a drive force to a driven element supported by a main printer frame, said drive force transmission mechanism comprising:

said main printer frame having a side wall;

fixture means integrally extending from said side wall of said main printer frame;

a subsidiary printer frame having tongue means and at least one shaft member integrally formed therewith, said tongue means detachably attached to said fixture means of said main printer frame and said subsidiary printer frame having said at least one shaft member extending from said subsidiary printer frame and having an end projected therefrom, said end of said shaft member being received in a hole formed in the main printer frame, to therein increase a rigidity of said at least one shaft member, said subsidiary printer frame and said at least one shaft member being an integrally molded synthetic resin structure; and at least one transmission member rotatably supported on said at least one shaft member to be engaged with said driven element which is supported by said main printer frame such that the drive force is transmitted thereto, said at least one transmission member comprising one member selected from a group of members comprising a gear, a cam and a lever.

2. A drive force transmission mechanism as set forth in claim 1, wherein said member selected from the group of members comprising said gear, said cam, and said lever is held in place by a resiliently-bendable support member integrally projected from said subsidiary frame.

3. A drive force transmission mechanism as set forth in claim 1, wherein said synthetic resin is selected from a group consisting of acrylonitrile-butadiene-styrene, polycarbonate, polyacetal, and tetrafluoroethyrene.

4. A drive force transmission mechanism applied to a printer to transmit a drive force to a driven element included in said printer, said drive force transmission comprising:

a main printer frame having fixture means integrally extending from a side wall thereof;

a subsidiary printer frame having tongue means and shaft members integrally formed therewith, said tongue means detachably attached to said fixture means of said side wall of said main printer frame of said printer and said subsidiary printer frame having said shaft members each with one end extending from said subsidiary printer frame and having another end projected therefrom, each said another end of said shaft members being received in corresponding holes formed in the side wall of said main printer frame, to therein increase rigidity of said shaft members, said driven element having an input gear provided on an outer surface of the side wall of said main printer frame, said subsidiary printer frame and said shaft members being an integrally molded synthetic resin structure; and a gear train accommodated in and held by said subsidiary printer frame so that gears included in said gear train are rotatably supported on said shaft members, said gear train being engaged with the input gears of said driven element at an output side thereof.

5. A drive force transmission mechanism as set forth in claim 4, wherein an electric motor is attached to said subsidiary frame as a drive source for said driven element, and said gear train is engaged with an output gear of said electric motor at an input side thereof.

6. A drive force transmission mechanism as set forth in claim 4, wherein said synthetic resin is selected from a group consisting of acrylonitrile-butadiene-styrene, polycarbonate, polyacetal, and tetrafluoroethyrene.

* * * * *